US006142259A

United States Patent [19]

Veletovac et al.

[11] Patent Number: 6,142,259

[45] Date of Patent: Nov. 7, 2000

[54] METHOD AND DEVICE FOR CONTROLLING A HYDRAULIC LIFT

[75] Inventors: Sead Veletovac, Dübendorf; Hubert Häussler, Unterägeri; Daniel Moser, Rudolfstetten; Roland Bisig, Einsiedeln; Richard Von Holzen, Menzingen, all of Switzerland

[73] Assignee: Bucher-Guyer AG, Switzerland

[21] Appl. No.: 09/155,790

[22] PCT Filed: Feb. 4, 1998

[86] PCT No.: PCT/CH98/00040

§ 371 Date: Feb. 10, 1999

§ 102(e) Date: Feb. 10, 1999

[87] PCT Pub. No.: WO98/34868

PCT Pub. Date: Aug. 13, 1998

[30] Foreign Application Priority Data

Feb. 6, 1997 [CH] Switzerland ..... 260/97
Mar. 22, 1997 [CH] Switzerland ..... 693/97

[51] Int. Cl.[7] ..... B66B 5/06

[52] U.S. Cl. ..... 187/287

[58] Field of Search ..... 187/286–288, 187/275

[56] References Cited

U.S. PATENT DOCUMENTS 4,418,794 12/1983 Manco ..... 187/17
4,637,495 1/1987 Blain ..... 187/29 A
4,715,478 12/1987 Nakamura et al. ..... 187/111
4,932,502 6/1990 Blain et al. ..... 187/111
5,040,639 8/1991 Watanabe et al. ..... 187/275
5,082,091 1/1992 Fargo ..... 187/17
5,243,154 9/1993 Tomisawa et al. ..... 187/286
5,373,121 12/1994 Nagel ..... 187/286
5,648,644 7/1997 Nagel ..... 187/288

*Primary Examiner*—Jonathan Salata
*Attorney, Agent, or Firm*—Burns, Doane, Swecker & Mathis

[57] ABSTRACT

The invention relates to a method and an apparatus for controlling a hydraulic elevator, in which a car (2) is movable up and down in an elevator shaft (1). The car (2) is connected to a reciprocating piston. The car (2) is driven by an oil pump (40), with which pressurized oil is pumped between a tank (41) and a reciprocating cylinder (3). The oil pump (40) is driven by a motor (39), which is supplied by a controllable power supply part (28). The speed of the car (2) is detected by a sensor (13). A control and governing unit (10) controls and regulates the devices that affect the motion of the car (2), namely the motor (39) and a valve unit (43). In upward motion, the speed of the car (2) is controlled by regulation the motor (39). According to the invention, in downward motion, closed- or open-loop control is exerted on the valve unit (43). At low speeds upon startup and in braking of the car (2), the speed regulation is effected by actuating the valve unit (43), while at higher speeds and in upward motion it is effected by regulating the motor (39).

11 Claims, 7 Drawing Sheets

METHOD AND DEVICE FOR CONTROLLING A HYDRAULIC LIFT

Figure 1:
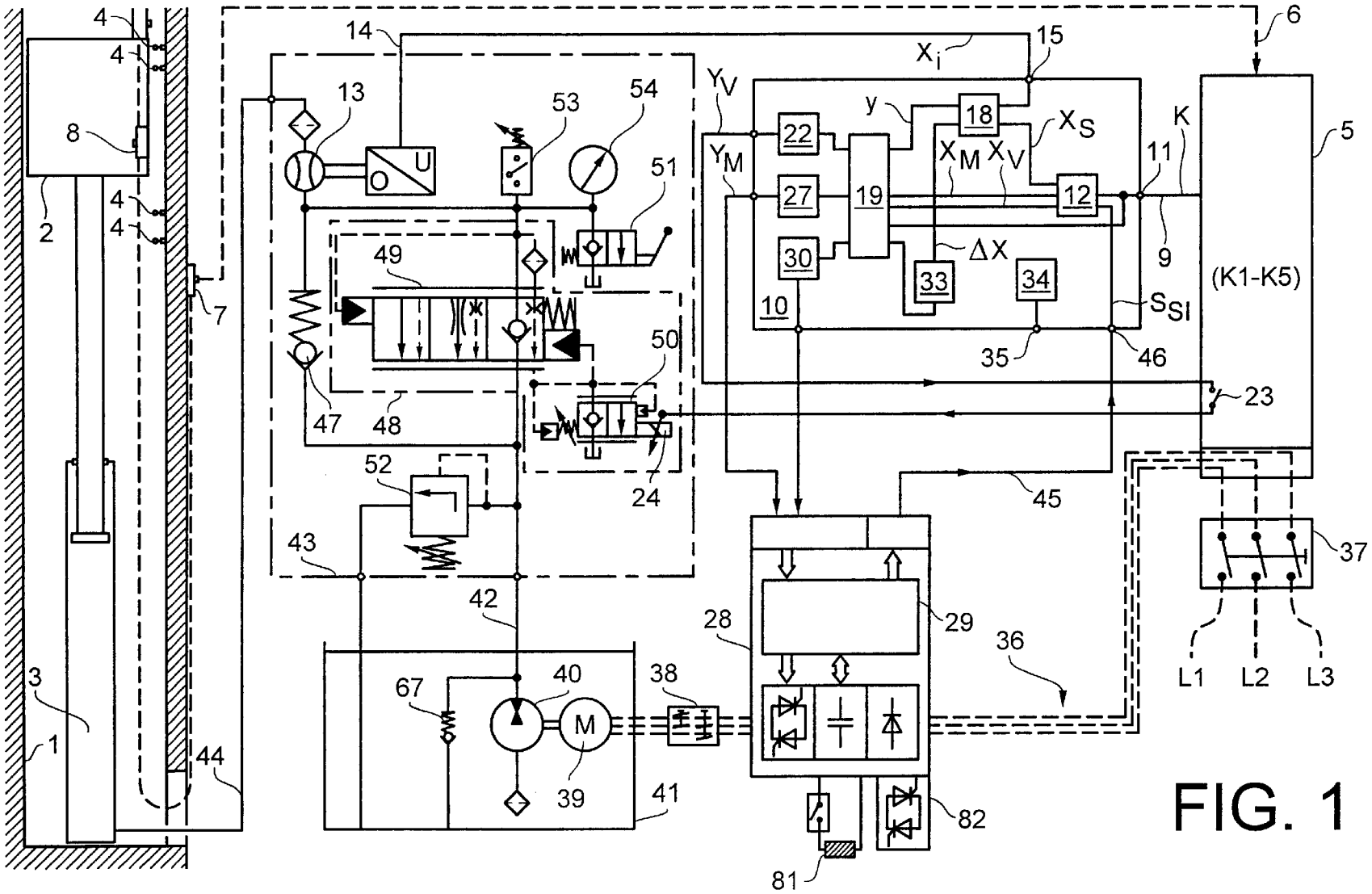

The invention relates to a method for controlling a hydraulic elevator as generically defined by the preamble to claim 1, and to an apparatus for performing the method as generically defined by the preamble to claim 5.

Such controls are suitable for instance for operating an elevator system in which a car in an elevator shaft can approach various positions, such as different floors of a building. The drive of the car is effected by the cooperation of a reciprocating piston, connected to the car, and a reciprocating cylinder which is filled with a pressurized oil. The reciprocating cylinder communicates via a cylinder line with a pump that is driven by a motor. By rotation of the motor and the pump in one direction, pressurized oil can be fed from an oil tank to the reciprocating cylinder, thus moving the car in the upward direction. By rotation of the motor and the pump in the opposite direction, pressurized oil is fed from the reciprocating cylinder into the oil tank, thereby moving the car downward. Because of the weight of the car itself, the pressurized oil in the reciprocating cylinder and in the cylinder line is constantly at a certain pressure.

To control the motion, it is known for instance from U.S. Pat. No. 5,243,154 for a motor rigidly coupled to the pump to be controlled in terms of its direction of rotation and speed of rotation. It is also known to utilize the weight of the car and the resultant pressure in the downward motion in order to drive the pump. Because of the rigid coupling with the motor, the motor acts then as a generator, and the energy generated in the downward motion is either converted to heat or can be fed into the power supply network by a return feed unit. In addition, between the reciprocating cylinder and the pump a valve unit may be present, with which additional influence can be exerted on the flow of pressurized oil between the reciprocating cylinder and the pump.

In the pumps typically used for the aforementioned purpose, leakage is unavoidable.

Leakage is a function of the prevailing pressure. As a result, in upward motion the pump rpm has to be somewhat higher than it would have to be if there were no leakage. As a consequence, whenever the car is to be stopped at a certain position, the pump has to run at a certain rpm, so that it can pump a large enough quantity of pressurized oil to compensate precisely for this leakage. This is known for instance from U.S. Pat. No. 4,593,792.

From U.S. Pat. No. 5,212,951, a generic hydraulic elevator system is known in which the control of the motion of the car is accomplished by a variable-speed motor acting on the pump. With the aid of an electrically controlled check valve, the pressure on the side toward the pump is first adapted, before the onset of motion of the car, to the pressure that prevails on the side of the check valve toward the reciprocating cylinder. Only after this pressure adaptation does the check valve open, so that the motion of the car begins. With this provision, jerky motions on starting up are largely avoided.

From British Patent GB A 2 243 927, a hydraulic elevator system is known in which an electromagnetic control valve is present. Once again, the motion of the car does not begin until the pump pressure exceeds the reciprocating cylinder pressure. Only after this pressure adaptation does the control valve open the communication from the pump to the reciprocating cylinder.

In all these known versions with speed-regulated motors, there is the problem that the motors have a certain rpm elasticity, which is also known as slip. The least possible rpm with full torque and no operational disruption is a function of this slip. Below a thus-dictated limit rpm, the rotational behavior of the motor is unstable, which expresses itself in rpm fluctuations.

The object of the invention is to create an embodiment that takes account of these circumstances such that even at very low speeds, such as the transition to a stop, it makes jerkless travel possible. At the same time, the hydraulic elevator and its control system should make do with only a few sensors and should allow the use of standard electrical components for controlling the motor.

This object is attained according to the invention by the characteristics of claims 1 and 5. Claim 1 pertains to the method of the invention, while claim 5 defines an apparatus with which the method of the invention can be performed. Advantageous refinements are recited in the dependent claims.

An exemplary embodiment of the invention will be described in further below in conjunction with the drawing.

Figure 2:
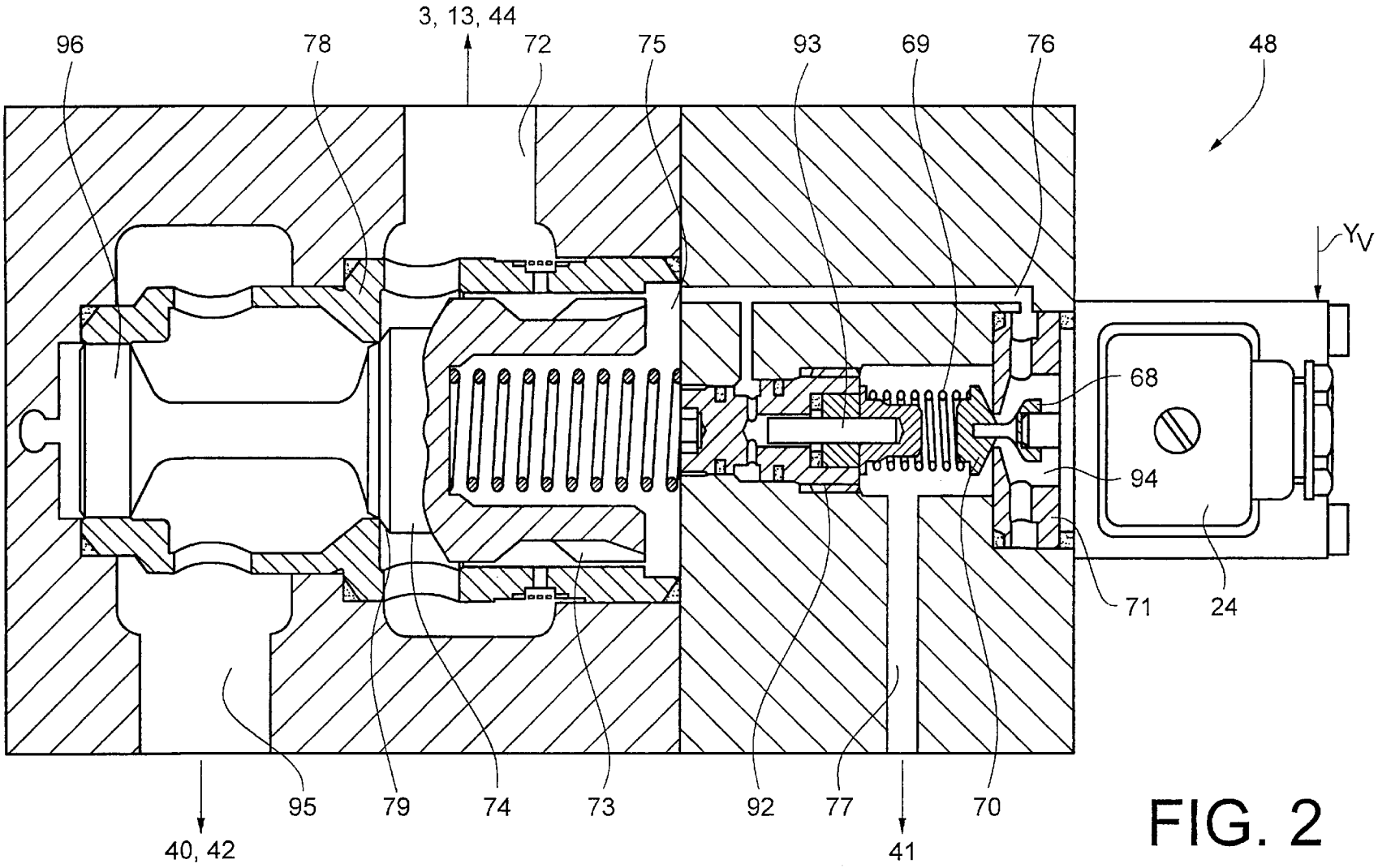
Figure 2A:
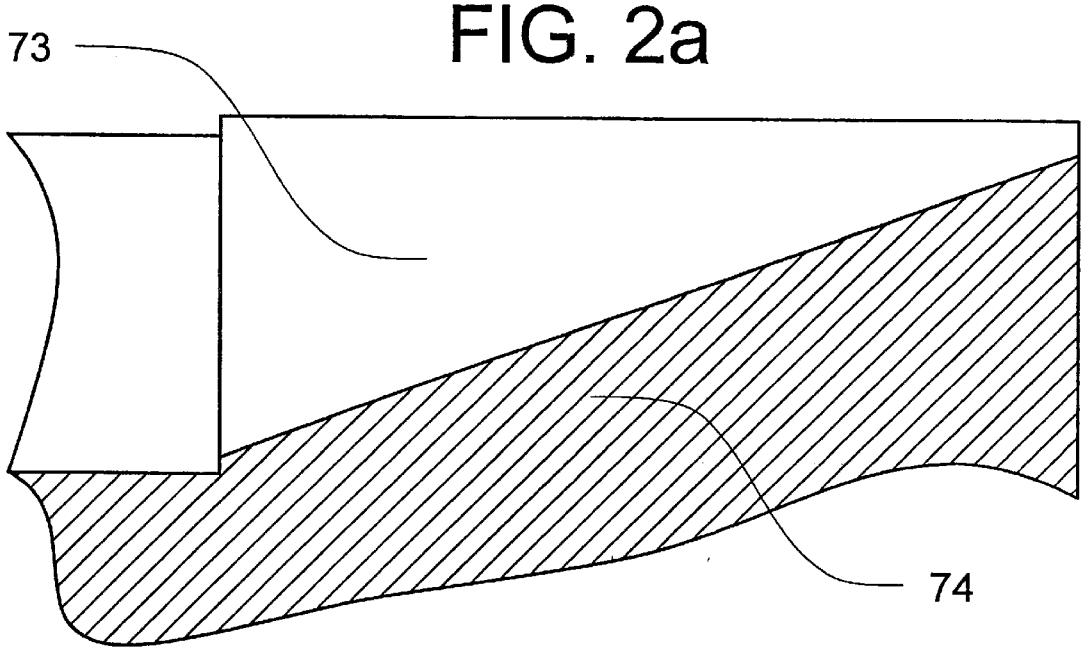
Figure 2B:
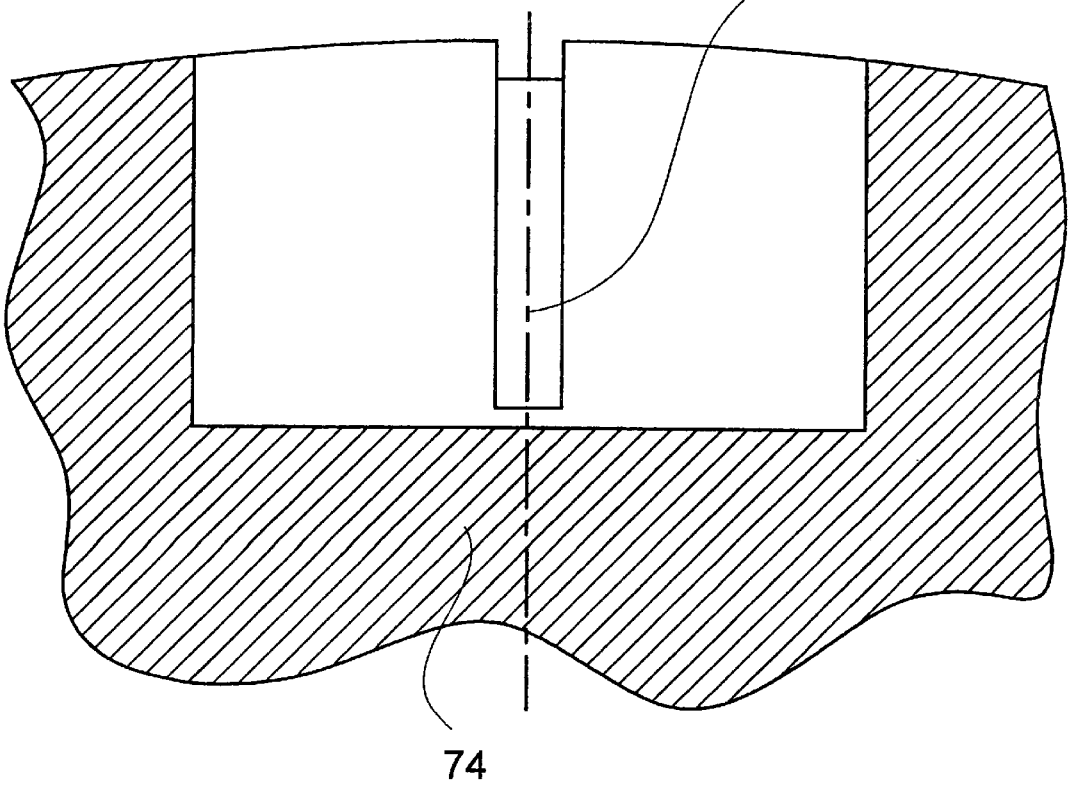

Shown are:

FIG. 1, a schematic diagram of a hydraulic elevator system with an apparatus used to control it;

FIG. 2, a fragmentary section through a control valve;

FIGS. 2*a* and 2*b*, details of a section; and

FIGS. 3–6, signal graphs for explaining the function.

In FIG. 1, an elevator shaft 1 is shown, in which a rail-guided car 2 can be moved. The car 2 is connected to a reciprocating piston of a reciprocating cylinder 3. Shaft pulse transducers 4 are disposed in the elevator shaft 1, which in cooperation with actuating devices, not shown in FIG. 1, mounted on the car 2 furnish information about the changes of position, such as the approach to a floor from above or from below.

FIG. 1 also shows an elevator controller 5, which communicates via a signal line 6 with external control units 7, which are assigned to the individual floors and of which only one is shown in FIG. 1, and a car control unit 8. The elevator controller 5 may for instance be a commercially available product, such as the "Aufzugssteuerung [Elevator Controller] Liftronic 2000" (made by Findili AG, Kleinandelfingen, Switzerland). From the elevator controller 5, a control line 9 leads to a control and governing unit 10. Over this control line 9, control command signals K are transmitted by the elevator controller 5 to the control and governing unit 10, a process that will be described hereinafter.

The control command signals K pass from the elevator controller 5 to a control input 11 of the control and governing unit 10. From this control input 11, these control command signals K are delivered to a desired value generator 12. FIG. 1 also shows a flow rate meter 13, with which the flow of pressurized oil from and to the reciprocating cylinder 3, and thus unequivocally the speed of the car 2 as well, are detected. This flow rate meter 13 communicates via a signal line 14 with a further input 15 of the control and governing unit 10, so that measured values for the volumetric flow, namely its actual values $x_i$, that originate in the flow rate meter 13 are available to the control and governing unit 10. The flow rate meter 13 may advantageously include a Hall sensor. One such flow rate meter is known from European Patent Disclosure EP B 1 0 427 102.

The desired value generator 12, from the control command signals K, generates a desired value $x_s$ for the speed of the car 2. Because of the unequivocal relationship between the car speed and the volumetric flow of pressurized oil, measured by the flow rate meter 13, this desired value for the car speed is at the same time the desired value $x_s$ of the volumetric flow. These two values, that is, the volumetric flow actual value $x_i$ and the volumetric flow desired value $x_s$, which can also be called the car speed actual value $x_i$ and the car speed desired value $x_s$, are delivered to a governor 18, which in a known manner from them determines a deviation Δx and from that in turn a controlling variable y. This controlling variable y is available at a first output of the governor 18.

From the control command signals K, the desired value generator 12 also directly generates desired values for the devices to be triggered by the control and governing unit 10, as will be described hereinafter.

All the desired values and also the control command signals K are delivered to a control block 19. This control block has three outputs: a first output leads to a first signal converter 22, whose output is carried to a valve drive 24, via a safety relay 23 included in the elevator controller 5. This valve drive 24 can advantageously have a magnetically acting drive, such as a proportional magnet. A second output of the control block 19 leads to a second signal converter 27, whose output is connected to a power supply part 28. This power supply part 28 includes a power setter 29, which by way of example is a frequency inverter. A third output of the control block 19 is connected to a third signal converter 30, whose output is also connected to the power supply part 28.

In FIG. 1, a control block 33 is also shown, which receives the information about the magnitude of the deviation Δx from a second output of the governor 18. This control block 33 compares the magnitude of the deviation Δx with a limit value and, whenever the magnitude of the deviation Δx exceeds this limit value, trips a signal which is delivered to the control block 19. Thus all the signals originating in the control block 19 can be set to zero, so that in an emergency the car 2 will come to a stop.

For the sake of completeness, a parameter block 34 is also shown, which communicates with a serial interface 35. Via this serial interface 35, a servicing unit, not shown, can be connected to the control and governing unit 10. In this way, parameters of the control and governing unit 10, such as the aforementioned limit value for the deviation Δx, can be called up and changed.

FIG. 1 also shows a high-power line 36, shown in the exemplary embodiment illustrated as a three-pole line, which is connected via a main switch 37 to the power supply network L1, L2, L3. By means of this high-power line 36, the electrical energy required to operate the hydraulic elevator is supplied to the power supply part 28. From the power supply part 28, the electrical energy is delivered to a motor 39, via a motor starting contactor 38, which may for instance comprise two series-connected starting contactors. In terms of what is shown in FIG. 1, the power supply network L1, L2, L3 is a three-phase or rotary-current network, and the motor 39 is correspondingly a three-phase motor. However, the invention is not limited to this. For instance, the motor 39 could be an arbitrary electric motor, including a dc motor. The power supply part 28 is designed in terms of its construction to suit the particular motor 39 used.

The motor 39 is rigidly connected to an oil pump 40, with which pressurized oil can be fed from an oil tank 41 into the reciprocating cylinder 3. Typically, the motor 39 and the oil pump 40 are disposed directly on this oil tank 41. The pressurized oil fed by the oil pump 40 passes via a pump line 42 to reach a valve unit 43 and from there flows via a cylinder line 44 to the reciprocating cylinder 3. The rotational direction of the motor 39 determines the flow direction of the pressurized oil. In one rotational direction, pressurized oil flows from the tank 41 via the pump line 42, valve unit 43 and cylinder line 44 to the reciprocating cylinder 3, as long as the rpm of the motor 39 is higher than the rpm required to compensate for the leakage from the oil pump 40. As a result, the car is moved in the upward direction. In the other direction of rotation, pressurized oil flows from the reciprocating cylinder 3 into the oil tank 41, via the cylinder line 44, the valve unit 43, and the pump line 42. This moves the car 2 in the downward direction.

It can also be seen from FIG. 1 that the power supply part 28 communicates with the control and governing unit 10 via a line 45 with a status input 46. Over the line 45, status signals $S_{st}$ pass from the power supply part 28 to the control and governing unit 10.

The valve unit 43 advantageously essentially comprises a check valve 47 and a down valve 48, which are disposed parallel to one another between the pump line 42 and the cylinder line 44. The down valve 48 in turn advantageously comprises a control valve 49 and a pilot control valve 50 acting on the control valve. The pilot control valve 50 is advantageously actuated by the aforementioned valve drive 24.

To meet safety requirements, an emergency drain valve 51 is also included in the valve unit 43; it is disposed on the side toward the cylinder line 44 of the communication between the check valve 47 and the down valve 48. A pressure limiting valve 52 is also disposed on the side toward the pump line 42 of the communication between the check valve 47 and the down valve 48. The equipment of such a system also in a known manner includes a pressure switch 53 and a manometer 54.

A reaspiration valve 67, whose function will be described hereinafter, is also disposed on the side of the oil pump 40 toward the pump line 42. The aforementioned flow rate meter 13 detects the speed of the pressurized oil flowing between the valve unit 43 and the reciprocating cylinder 3 in the cylinder line 44. It is advantageously disposed inside the valve unit 43.

A brake unit 81 and/or a return feed unit 82, whose function will also be described hereinafter, can be connected to the power supply part 28.

Typically, the car 2 of this kind of hydraulic elevator is operated at at least two rated speeds, namely a first speed (fast speed) and a second speed (creep speed) and transitional phases between these two speeds, on the one hand, and the second speed (creep speed) and a stop on the other, which are distinguished by continuous variation in speed. The second speed (creep speed) can for instance amount to from 5 to 10% of the first speed. If the elevator controller 5, on the basis of a control action at an external control unit 7 or at the car control unit 8 that results in a drive command signal, outputs a control command signal K to the control and governing unit 10, then the car 2 is set in motion. As will be described hereinafter, the motion begins with increasing acceleration until the first speed (fast speed) is reached. Once this first speed is reached, travel continues at this constant speed. When the elevator approaches its destination, a delay phase begins. Within this delay phase, the second speed (creep speed) is finally reached. Braking down to a stop then takes place. For reasons of passenger comfort, both acceleration and delay proceed in sliding fashion. The problem the invention seeks to solve occurs in downward travel in the range of low speeds, namely speeds approximately equal to or less than the second speed (creep speed).

According to the invention, in downward travel in the range of low speeds in startup and braking phases, the car speed is regulated by action on the valve unit 43, while at higher speeds it is regulated by action on the power supply part 28, and thus on the motor 39 and the oil pump 40, with the valve unit 43 being controlled simultaneously in upward travel, the valve unit 43 is not triggered, and the governing of the car speed is effected, in all speed ranges, by action on the power supply part 28, and thus on the motor 39 and the oil pump 40.

It is advantageous if the speed of the car 2 is the sole controlled variable, and if as a sensor the flow rate meter 13 is used, whose actual value $x_i$ is delivered to the control and governing unit 10.

This method will now be described in further detail in conjunction with FIG. 1. Rotation of the motor 39 in one direction likewise rotates the oil pump 40 in that direction. As a result, pressurized oil is pumped into the pump line 42 by the oil pump 40. In the pump line 42, a pressure occurs, which rises until such time as the check valve 47 included in the valve unit 43 opens. This opening begins when the pressure in the pump line 42 exceeds the pressure in the cylinder line 44. The pressurized oil now flows through the flow rate meter 13 and the cylinder line 44 into the reciprocating cylinder 3. As a result, the car 2 is moved upward. The governing of the speed of the car 2 is effected in such a way that the desired value $x_s$ predetermined by the desired value generator 12 is compared with the actual value $x_i$ furnished by the flow rate meter 13; this comparison is performed inside the governor 18. The governor 18 outputs the controlling variable y to the control block 19. On the basis of the drive command signals also present at the control block 19, in upward travel the control block 19 passes the controlling variable y on to the signal converter 27. In this signal converter 27, a control command $Y_M$ is generated from the controlling variable y. The control command $Y_M$ is by its nature adapted to the member to be controlled, namely the power supply part 28 having the power setter 29. If the motor 39 is a three-phase motor and the power setter 29 is a frequency inverter, then the control command $Y_M$ must be adapted to the frequency inverter used. As the frequency inverter, it is possible for instance to use the type G9S-2E with the brake chopper BU III 220-2 (made by Fuji). In that case, the signal converter 27 is embodied such that from the controlling variable y, a control command $Y_M$ precisely fitting this type of frequency inverter is generated.

In upward travel, as described, accordingly the control and governing unit 10 actuates only the action chain containing the power supply part 28, the motor 39, and the oil pump 40, the power supply part having the power setter 29. At all incident speeds, the governing of the speed is effected by regulating the rpm of the motor 39 and thus the rpm of the oil pump 40.

In downward travel, speed governing is done differently. At a control command signal for downward travel, the desired value generator 12 generates not only the desired value $x_S$ but advantageously a further desired value as well, namely a desired value $x_M$ serving to trigger the motor. From the control block 19, this desired value $x_M$ is carried on to the signal converter 27, which generates the control command $Y_M$ in a manner analogous to the upward travel described above. Unlike the upward travel, however, here it is not a signal within the closed-loop control chain but a purely open-loop control variable that is involved. Accordingly, at first the motor 39 is controlled only in open-loop fashion rather than being regulated, i.e. closed-loop controlled. The motor 39 and thus the oil pump 40 now rotate in the reverse direction. Since the valve unit 43 is not triggered and is thus closed, a negative pressure, which is limited by automatic opening of the reaspiration valve 67, occurs in the pump line 42. According to the invention, now the valve unit 43, namely the down valve 48, is triggered as well. This is done in such a way that the valve drive 24 is triggered. Its triggering actuates the pilot control valve 50, which in turn acts on the control valve 49. The triggering of the valve drive 24 is effected by means of a control command $Y_V$; it does not matter whether at the onset of triggering the control command $Y_V$ is generated from a pure open-loop control signal or from a signal of a closed-loop control chain. According to the invention, however, at least soon after the onset of triggering, the control command $Y_V$ is formed in the context of closed-loop control. This is done in that the desired value generator 12 predetermines a desired value $x_s$ for the speed, which the governor 18 compares with the actual value $x_i$ furnished by the flow rate meter 13 and from the deviation $\Delta x$ forms the controlling variable y as a control signal. The control block 19 carries this controlling variable y onto the signal converter 22, which converts the controlling variable y into a control command $Y_V$. The valve drive 24 is triggered with this control command $Y_V$. As the control command $Y_V$ increases, the down valve 48 opens in such a way that the valve drive 24 actuates the pilot control valve 50, which in turn actuates the control valve 49. Now speed governing accordingly takes place according to the invention, by action on the down valve 48. At the same time, as noted, the motor 39 is merely open-loop controlled.

As soon as a certain speed is reached, whose value can be predetermined and is approximately equivalent in terms of magnitude to the second rated speed (creep speed), the closed-loop control, or governing, is switched over according to the invention. This is done in that the desired value generator 12 generates, in addition to the desired values $x_s$ (desired value for the car speed) and $x_M$ (actuating variable for the motor 39), a further desired value $x_V$, which is an actuating variable for the down valve 48. According to the invention, the controlling variable y, which represents the signal of the closed-loop control chain, is switched over by the control block 19 from the signal converter 22 to the signal converter 27, while at the same time the signal converter 22 receives the desired value $x_V$. Thus the regulation of the speed of the car 2 is now no longer effected by means of action on the down valve 48 but rather by action on the rpm of the motor 39. In order that the speed of the car 2 will be completely controllable by regulation of the rpm of the motor 39, the above-described operation of switching over the controlled variable is followed by slowly moving the down valve 48 to the "fully open" position, which is effected by a suitable increase in the desired value $x_V$. The desired value $x_V$ is generated by the desired value generator 12 and is now purely an actuating variable.

On approaching the destination, a reduction in the speed of the car 2 is effected, by reducing the desired value $x_s$. In a continuation of the above-described action, the regulation is effected by reducing the control command $Y_M$ At the same time, the desired value $x_V$ is reduced, and as a consequence the down valve 48 is slowly controlled in the closing direction. At the moment when the desired value $x_s$ attains a predetermined value, which in terms of magnitude is approximately equivalent to the second rated speed (creep speed), a switchover of the controlled variable is now effected again. The controlling variable y, that is, the signal of the closed-loop control chain, is now applied to the signal converter 22 again by the control block 19, and the signal converter 27 receives the desired value $x_M$. After the switchover, the speed regulation is again effected by triggering the down valve 48, while the motor 39 is merely open-loop controlled in accordance with the specifications by the desired value $x_M$. Until the car comes to a stop, the speed regulation is now effected by reducing the desired value $x_s$, which is done by the desired value generator 12; as a consequence, the down valve 48 is actuated in the closing direction in the context of closed-loop control, until it is fully closed. The car 2 is now at a stop. Parallel to this, the actuating variable for the motor 39, which is the desired value $x_M$, is reduced down to zero.

As described, whenever the motor 39 or the down valve 48 is not operated as part of the closed-loop control chain, the motor 39 or down valve 48 is triggered by predetermined actuating variables. This has the advantage that at the moment of the switchover operation for the controlled variable, no instabilities whatever, such as closed-loop control oscillations or abrupt changes in the regulation behavior occur.

The apparatus of the invention, in terms of the above-mentioned method, is characterized in that the control and governing unit 10 has means, with the aid of which the oil pump 40 and the valve unit 43 are triggerable in such a way that upon downward motion at a speed approximately equal to or less than the second speed (creep speed), the regulation of the speed of the car 2 by the control and governing unit 10 is effected on the basis of the signal of the sensor 13 in such a way that regulating action is exerted on the valve unit 43, while in downward motion with a speed approximately equal to or greater than the second speed (creep speed) and in upward motion, the regulation of the speed of the car 2 is effected in that regulating action is exerted on the power supply part 28 and thus on the motor 39 and the oil pump 40.

These means are as follows: First, the desired value generator 12, which as a function of control command signals K present at its input generates desired values for the speed of the car 2, desired values $x_M$ of the rpm of the motor, and desired values $x_V$ for triggering the valve unit 43; second, the governor 18, which from the respective desired value $x_s$ for the speed of the car 2 and an actual value $x_i$ detected by the sensor 13 for the speed of the car 2 finds a controlling variable y; and third, the control block 19, which as a function of the control command signals K, the controlling variable y, and the desired values $x_M$ and $x_V$ generates a control command $Y_V$ for the valve unit 43 and a control command $Y_M$ for the motor 39. According to the invention, the control block functions such that in downward motion at a speed approximately equal to or less than the second speed (creep speed), the control command $Y_V$ for the valve unit 43 represents the controlled variable of the closed control loop, while in downward motion at a speed approximately greater than the second speed (creep speed) and in upward motion, the control command $Y_M$ for the motor 39 represents the controlled variable of the closed control loop.

It is extraordinarily advantageous if as the sole sensor, with whose aid the speed of the car 2 is detected, the flow rate meter 13 is present. The measurement variable output to the control and governing unit 10 by this flow rate meter 13 correlates with the speed of the car 2, in fact doing so under all circumstances, including for instance changes in the temperature of the pressurized oil, which involves a change of viscosity, and if the load of the car 2 changes.

In FIG. 2, an exemplary embodiment for the down valve 48 is shown in fragmentary section. The valve drive 24 can be triggered by the control command $Y_V$. By way of example, the control command $Y_V$ is a voltage. In the valve drive 24, a magnetic field proportional to this voltage is generated and exerts a force on a magnet armature, not shown in FIG. 2. This magnet armature is connected to a tappet 68, so that the force exerted on the magnet armature also acts on the tappet 68. Also shown is a spring 69, which is based against a cone 68. The tappet 68 engages the inside of this cone 70, so that the force generated by the valve drive 24 is transmitted to this cone 70. The done 70 is thereby movable relative to a pilot control bush 71. The opening cross section that can be uncovered by the stroke of the cone 70 relative to the pilot control bush 71 determines the effect of the pilot control valve 50 (FIG. 1).

FIG. 2 also shows a cylinder chamber 72, which communicates with the cylinder line 44 via the flow rate meter 13, not shown here. Also shown is a control piston 74, which is provided with slits 73 and divides the cylinder chamber 72 from a control chamber 75. This control chamber 75 communicates via a bore 76 with a pilot control chamber 94. A bore 77 that leads to the tank 41 (FIG. 1) is located on the far side of the pilot control bush 71.

Reference numeral 78 designates a guide cylinder that serves to guide the control piston 74. Via two openings in the guide cylinder 78 and the slits 73, a passage exists between the cylinder chamber 72 and the control chamber 75. The guide cylinder 78, on its inside, and the control piston 74, on its outside, are also designed such that an uncoverable opening cross section 79 exists between them; its size, which is variable by the motor of the control piston 74, determines the flow of pressurized oil between the cylinder chamber 72 and a pump chamber 95, which communicates via the pump line 42 via the oil pump 40.

The aforementioned spring 69, which is braced on one end against the cone 70, is braced on the other end against a setting screw 92. A compensation pin 93 acts as a safety element in the event of excess pressure on or breakage of the spring 69. Finally, a piston head 96 is shown, which is movable in a bore of the guide cylinder 78 and serves to guide the control piston 74 precisely.

The left half of FIG. 2 thus essentially shows the control valve 49 (FIG. 1), while the pilot control valve 50 (FIG. 1) is shown on the right.

FIGS. 2*a* and 2*b* are details of a fragmentary section. Details of the slits 73 in the control piston 74 are shown. In conjunction with FIG. 2, it can be seen from FIG. 2*a* that the slits 73 extend axially as far as one end of the control piston 74. The depth of the slits 73 decreases linearly to the end of the control piston 74, with a slope of approximately 20°, for instance. The slits 73 act as inlet diaphragms to the control chamber 75 (FIG. 2). In the closing position of the control piston 74 shown in FIG. 2, the slits 73 uncover a minimal opening. As the stroke length of the control piston 74 increases, the cross-sectional area of these inlet diaphragms increases. This acts as an internal, hydraulic-mechanical countercoupling, with which greater positional accuracy, dynamics and resolution of the motion of the control piston 74 are attained.

The mode of operation of this down valve 48 will now be described. FIG. 2 shows the closing position, which exists whenever no control command $Y_V$ is applied to the valve drive 24. In this position, the same pressure prevails in the cylinder chamber 72, the control chamber 75, and the pilot control chamber 94. As soon as a control command $Y_V$ and thus a voltage are applied to the valve drive 24, the proportional magnet contained in the valve drive 24 generates a magnetic field, as already noted, which exerts a force on the tappet 68 and thus on the cone 70. A motion of the cone 70 does not occur until this force becomes greater than the force exerted by the spring 69. An opening is created between the cone 70 and the pilot control bush, and by way of this opening, pressurized oil can flow away from the pilot control chamber 94 into the tank 41, via the bore 77. As a result, the pressure in the pilot control chamber 94 drops. This causes the control piston 74 to move, and thus causes the opening cross section 79 to be other than zero. As a consequence, pressurized oil can flow out of the cylinder chamber 72 into the pump chamber 95, which causes a downward motion of the car 2 (FIG. 1).

As the control command $Y_V$ increases, the opening cross section 79 becomes greater. Thus if the control command $Y_V$ is formed and becomes operative within the context of the closed-loop control chain, the speed of the car 2 can be governed by the action on the down valve 48 contained in the valve unit 43. As already noted, this occurs upon downward travel in the range of low speeds.

It is advantageous if the down valve 48 is embodied such that the piston head 96 of the control piston 74 has the same diameter as the sealing face in the region of the opening cross section 79. Thus no force resulting from the pressure in the pump chamber 95 acts upon the control piston 74. The control piston 74 is thus hydraulically balanced, which has a favorable effect on the dynamics of control of the control piston 74.

Figure 3:
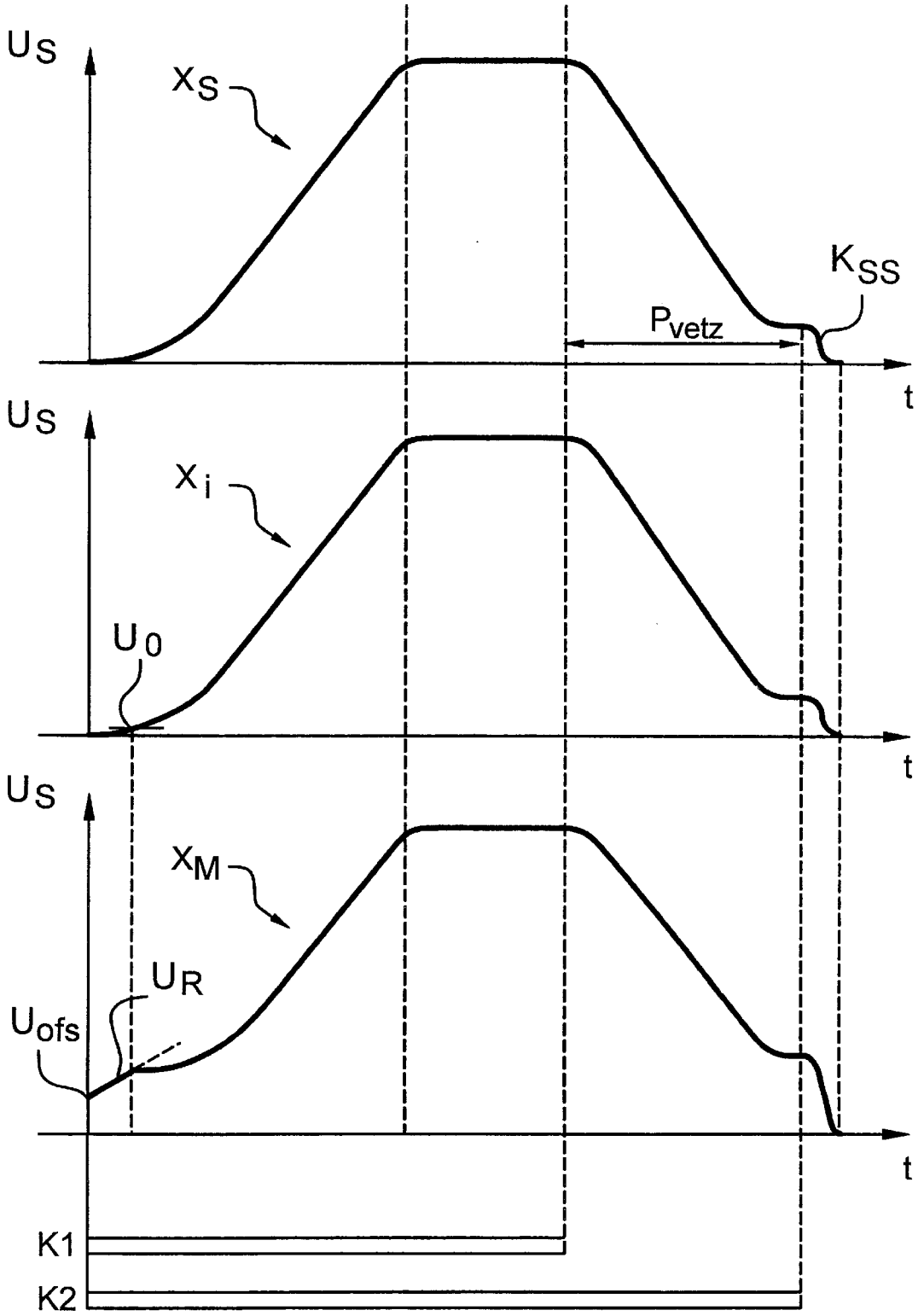

FIGS. 3–6 will now be described in further detail; they show the motion of the car 2 in terms of selected signals. In FIG. 3, three graphs are shown. The upper one is a voltage and time diagram showing the course of the desired value $x_s$ for the speed of the car 2 (FIG. 1). This should be understood as merely an example in the case of an analog control and governing unit 10 (FIG. 1), in which the desired value $x_s$ is represented by a voltage. In the case of a digital control and governing unit 10 with a microprocessor, the course over time of the desired value $x_s$ is represented by a variable. This is equally applicable to FIGS. 4–6 that follow. What is shown is the course of travel of the car 2 (FIG. 1) from one stop to the next.

The middle graph in FIG. 3 shows the course of the actual value $x_i$ of the actual travel speed of the car 2 (FIG. 1), measured by the flow rate meter 13. Once again, it is a voltage and time graph, representing the voltage signal output by the flow rate meter 13. In the case of a digital control and governing unit 10 (FIG. 1), this could also be shown as a variable, which would be output to the control and governing unit 10 (FIG. 1) by an analog/digital converter. If the governing of the speed of the car 2 (FIG. 1) by the control and governing unit 10 (FIG. 1) is unobjectionable, then the courses of $x_i$ and $x_s$ are virtually identical.

In the lower graph of FIG. 3, the course over time of the control command $Y_M$ is shown. This control command $Y_M$ is represented by a voltage course. Below the bottom graph, two control command signals K generated by the elevator controller 5 (FIG. 1) are shown, namely a first control command signal K1, which is set in an upward travel and is reset by the approach to the destination as tripped by a shaft pulse transducer 4 (FIG. 1), and a second control command signal K2, which is set upon upward travel as well but is not reset until whenever the car 2 (FIG. 1) approaches a second shaft pulse transducer 4 (FIG. 1), which is located closer to the intended destination.

The lower graph in FIG. 3 shows that by setting the control command signals K1 and K2, the control command $Y_M$ is reset from zero to a value that corresponds to an offset value $U_{ofs}$. This starts the motor 39 (FIG. 1) and consequently the oil pump 40. Because of inertia, leakage from the oil pump 40, and the compressibility of the pressurized oil, however, this sudden change in signal does not cause any jerking in the car 2. Initially, a pressure must also first be built up in the pump line 42. As soon as this pressure exceeds the pressure in the cylinder line 44, the check valve 47 opens automatically. The offset value $U_{ofs}$ should therefore advantageously be precisely large enough that the rpm of the motor 39 is precisely high enough that a pressure approximately equivalent to the pressure in the cylinder line 44 will build up in the pump line 42. The magnitude of the offset value $U_{ofs}$ may be among those parameters that are stored in memory in the parameter block 34 and that can be varied via the serial interface 35. Once the motor 39 starts with a control command $Y_M$ corresponding to the offset value $O_{ofs}$, the control of the motor 39 is effected in accordance with a ramp function $U_R$. The control command $Y_M$ now rises continuously. In the middle graph of FIG. 3, a threshold value $U_0$ is plotted. This threshold value $U_0$, which is preferably likewise adjustable as a parameter, amounts for instance to approximately 0.5 to 2% of the maximum value of the desired value $x_s$ or the actual value $x_i$. At this moment, the control in accordance with the ramp function $U_R$ is ended, and the closed-loop control or governing of the speed of the car 2 is thus begun. This method of initial open-loop control of the speed with a transition to closed-loop control or governing of the speed is especially advantageous, because the transition from open- to closed-loop control takes place at the moment when a certain speed is reached in the context of the open-loop control. Thus at the transition from open- to closed-loop control, there are no abrupt-change functions or control oscillations.

The further course of the control command $Y_M$ over time is thus solely the result of governing of the motor 39 by the governor 18 on the basis of the desired value $x_s$ of the speed of the car and on the basis of the actual value $x_i$. The curve for the desired value $x_s$ (top graph) then rises up to a maximum that corresponds to the aforementioned first speed (fast speed). The course of the actual value $x_i$ and the course of the control command $Y_M$ are then a consequence of the governing.

As soon as the control command signal K1 has been reset, a delay phase $p_{verz}$ (top graph in FIG. 3) begins. The desired value $x_s$ is now reduced by the desired value generator 12 (FIG. 1), as represented by the curve course. The course of the actual value $x_i$ and the course of the control command $Y_M$ are once again a consequence of the governing. The end of the delay phase $P_{verz}$ is characterized by the continuously variable transition to a speed that corresponds to the aforementioned second speed (creep speed). Upon a drop in the control command signal K2 because of the approach of the car 2 (FIG. 1) to the second shaft pulse transducer 4 (FIG. 1), the desired value $x_s$ is formed by the desired value generator 12 in accordance with a soft-stop desired value curve $K_{ss}$ (top graph in FIG. 3), which is characterized by a sliding transition from the second speed (creep speed) to a standstill. The course of the actual value $x_i$ and the course of the control command $Y_M$ are once again a consequence of the governing of the motor 39 by the governor 18. Because of the reduction in the rpm of the motor 39, the quantity of pressurized oil fed by the oil pump 40 is also reduced. Because of leakage from the oil pump 40, it happens while the rpm of the motor 39 is still finite that the pumped quantity of pressurized oil drops to zero. As a consequence, the pressure generated by the oil pump 40 in the pump line 42 is reduced as well. As soon as this pressure drops below the pressure in the cylinder line 44, the check valve 47 automatically closes, which causes the car 2 to stop.

Figure 4:
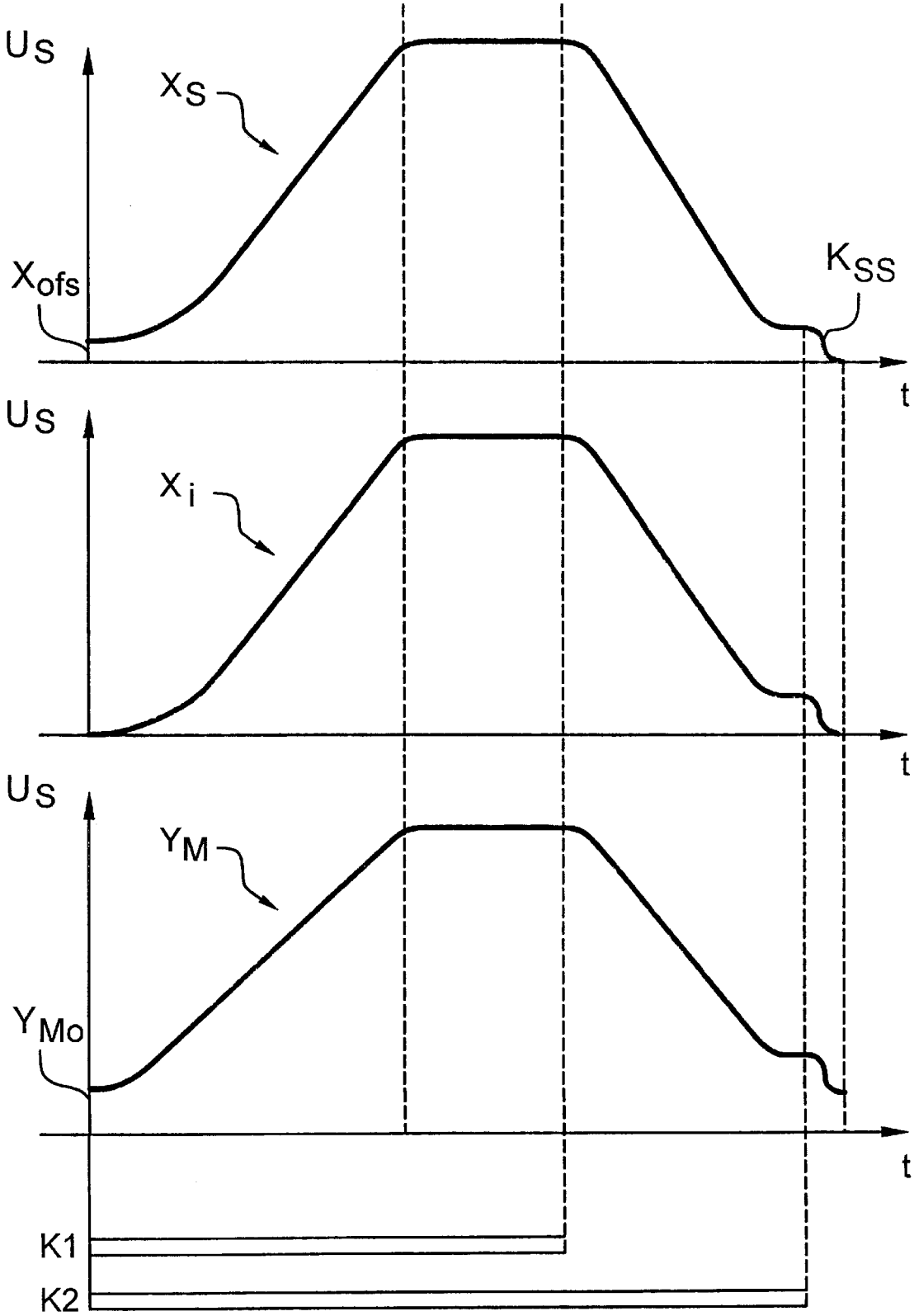

While in FIG. 3 described above a first variant of the open- and closed-loop control is shown for upward travel, a second variant will be described now in terms of FIG. 4. FIG. 4 is largely equivalent to FIG. 3, and below only its differences from FIG. 3 will be described. In the method of FIG. 4, the offset $U_{ofs}$ and the ramp function $U_R$ for the control command $Y_M$ are dispensed with. Instead, the function for the desired value $S_S$ for the speed of the car 2 is started with an offset $X_{ofs}$. This means that from the very outset, starting is done with closed-loop control, or governing. Despite the abrupt change in the desired value at the outset, namely from $x_s=0$ to $x_s=X_{ofs}$, an abrupt change does not occur in the actually attained speed, as the middle graph for the actual value $x_i$ shows, even though because of the governing, the control command $Y_M$ at the outset jumps from zero to a finite value $Y_{Mo}$. The reasons have already been mentioned in the description of FIG. 3: Because of inertia, leakage from the oil pump 40, and the compressibility of the pressurized oil, the startup nevertheless occurs without jerking.

Figure 5:
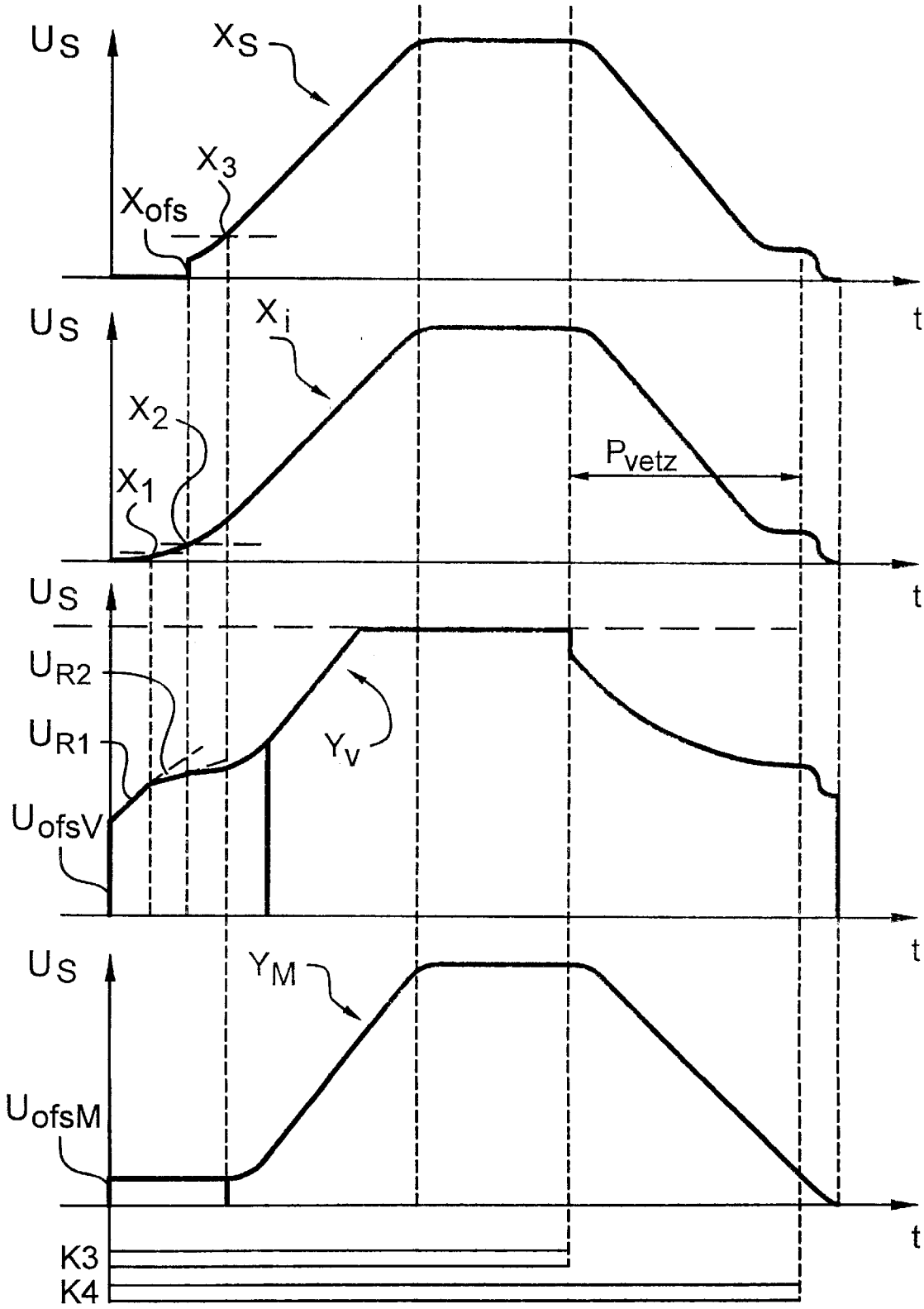

Two alternative methods for downward travel will now be described, in conjunction with FIGS. 5 and 6. FIG. 5 shows a first method for downward travel on the basis of selected signals. FIG. 5 shows four graphs. The upper graph, in a voltage and time diagram, shows the course of the desired value $x_s$ for the speed of the car 2 (FIG. 1) in the same way as in FIGS. 3 and 4. Also analogously to FIGS. 3 and 4, the second graph from the top shows the course of the actual value $x_i$ of the speed of the car 2, represented by the measured value of the flow rate meter 13 (FIG. 1). In the third graph, the course over time of the control signal $Y_V$ is shown, which is output by the control and governing unit 10 to the valve drive 24 for open-loop control of the down valve 48. The bottom graph, again analogously to FIGS. 3 and 4, shows the course over time of the control command $Y_M$. At the bottom, two control command signals K generated by the elevator controller 5 (FIG. 1) are shown, namely a third control command signal K3, which is set on a downward travel and is reset by the approach to the destination, tripped by a shaft pulse transducer 4 (FIG. 1), and a second control command signal (K4), which is also set upon downward travel but is not reset until the car 2 (FIG. 1) approaches a second shaft pulse transducer 4 (FIG. 1) that is located nearer the intended destination.

By means of the control command signals K3 and K4, at time $t_o$ (third graph from the top, but this time axis is applicable to all four graphs), the desired value generator 12 (FIG. 1) of the control and governing unit 10 first generates an offset value $U_{ofsM}$ (bottom graph) for the control command $Y_M$, and this value is delivered to the power supply part 28 by the control block 19. The motor 39 and pump 40 accordingly rotate at a correspondingly predetermined rpm. What is shown here is only the absolute value; however, as can already be inferred from the above description, the rotational direction of the motor 39 and 40 is reversed from that for the upward travel. A negative pressure is thus created in the pump line 42. To limit this negative pressure in such a way as to avoid cavitation of the pump 40, the reaspiration valve 67 now opens.

At the same time, at time $t_0$, the desired value generator 12 (FIG. 1) of the control and governing unit 10 first generates an offset value $U_{ofsV}$ (third graph from the top) for the control command $Y_V$, which is then delivered by the control block 19 to the valve drive 24 to trigger the down valve 48. The magnitude of the offset value $U_{ofsV}$ is dimensioned such that the force exerted on the tappet 68 (FIG. 2) by the magnet armature is still less than the prestressing of the spring 69, so that the cone 70 does not yet lift away from the pilot control bush 71. Thus the cone 70 does not yet execute any stroke, and the pilot control valve 50 (FIG. 1) thus still remains closed.

Also at time $t_0$, a first desired value ramp $U_{R1}$ for the control command $Y_V$ is started. The force generated by the valve drive 24 and exerted on the tappet 68 (FIG. 2) thus rises. As soon as this force exceeds the prestressing of the spring 69, the cone 70 lifts away from the pilot control bush 71. Consequently the pilot control valve 50 opens, and hence the control valve 49 as well. Pressurized oil can thus escape from the cylinder line 44 in the direction of the tank 41, and the motion of the car 2 (FIG. 1) begins. This is expressed directly in the fact that the actual value $x_i$ now becomes other than zero, as the second graph shows.

As soon as the speed of the car 2 has reached a first threshold value $x_1$ (second graph), the first desired value ramp $U_{R1}$ for the control command $Y_V$ is discontinued. This is equivalent to time $t_1$. At that moment, a second, somewhat shallower desired value ramp $U_{R2}$, for the control command $Y_V$ is started. This limits the speed increase in the motion of the car 2, so that no jerking on starting up occurs. As soon as the speed of the car 2 has then reached a second threshold value $x_2$ (second graph), the second desired value ramp $U_{R2}$ for the control command $Y_V$ is discontinued. This is equivalent to time $t_2$.

At time $t_2$, the function for the desired value $x_s$ of the speed of the car 2 is now started with an offset value $X_{ofs}$. This means that at this moment the purely open-loop control is terminated, and closed-loop control or governing is begun. Despite the abrupt change in the desired value from $x_s=0$ to $x_s=X_{ofs}$, no abrupt change in the actually attained speed occurs, as the second graph shows for the actual value $x_i$. This can be accomplished by selecting the offset value $X_{ofs}$ equal to the second threshold value $x_2$. But even if that were not the case, the transition from open- to closed-loop control would still be free of jerking, because of inertia and the compressibility of the pressurized oil.

Now, from time $t_2$ on, governing of the speed of the car 2 (FIG. 1) takes place, in that the actual value $x_i$ and the desired value $x_s$ are compared by the governor 18, which via the control signal y and the control block 19 generates a control command $Y_V$ and sends it to the valve drive 24; this control command represents a genuine controlled variable. Governing of the speed of the car 2 is now accordingly effected by influence on the down valve 48.

In accordance with the increasing desired value $x_s$, the control command $Y_V$ and the actual value $x_i$ also increase. As soon as the desired value $x_s$ has reached a threshold value $x_3$, which is true at time $t_3$, a switchover in the governing takes place. From the control signal y, the control block 19 now no longer generates the control command $Y_V$ for the down valve 48 but rather the control command $Y_V$ for the power supply part 28 and thus for the motor 39.

At the same time, the control block 19 continues to generate the control command $Y_V$, but now no longer on the basis of the controlling variable y but rather on the basis of the predetermination of desired values $x_V$ (FIG. 1), which are generated by the desired value generator 12. The desired value xv then increases relatively quickly, which is expressed in the increasing control command $Y_V$ (FIG. 5, third graph from the top). The down valve 48 is thus directed in the direction of "fully open" and thus increasingly, and finally completely, loses its effect on the speed of the car 2. The governing of the speed of the car 2 now takes place solely in such a way that the governor 18 compares the desired value $x_s$ and the actual value $x_i$ and from the comparison forms the controlling variable y, which is then converted by the control block 19 into a control command $Y_M$. This control command $Y_M$ is part of the closed-loop control chain.

As already described above for the upward travel, the desired value $x_s$ now rises up to maximum, and the control and governing unit 10 accordingly assures that the control command $Y_M$ will rise accordingly. Consequently the actual value $x_i$ increases as well.

Analogously to the upward travel, when the control command signal K3 decreases a delay phase is initiated. The desired value $x_s$ is reduced accordingly, and thus in the context of governing it follows that the control command $Y_M$ and consequently the actual value $x_i$ decrease as well. At the same time, in accordance with the predetermination by the desired value generator 12, the desired value $X_V$ is reduced, which is expressed in the decrease in the control command $Y_V$ (FIG. 5, third graph).

With the actuation of the down valve 48 in the closing direction, which is effected by the reduction in the control command $Y_V$, the down valve (48) increasingly gains influence over the flow of pressurized oil from the cylinder 3 (FIG. 1) back into the tank 41. However, this increasing influence is automatically cancelled out by a corresponding variation of the control command $Y_M$. At a virtually arbitrary time within the delay phase $P_{verz}$, the governing can now once again be switched over from the control command $Y_M$ to the control command $Y_V$. At the moment the p2 is reached, for which analogously to upward the travel the drop in the control command signal K4 is determinative, the state is in any case regained where the control command $Y_V$ is due to governing by the governor 18, while the control command $Y_M$ is determined by the desired value generator 12, because of its predetermination of the desired value $X_V$. Until the car comes to a stop, governing of the speed of the car 2 is then effected in accordance with the predetermination of the desired value $x_S$ (top graph) solely in that the further closure of the down valve 48 is the result of the control command $Y_V$, generated via the controlled variable y.

At the moment when the down valve 48 closes completely, the car 2 is again at a stop.

The fact that at the moment the car 2 comes to a stop the control signal $Y_V$ still has a finite value has to do with the fact that the pilot control valve 50, because of the effect of the prestressing of the spring 69, already closes when a control signal $Y_V$ of finite magnitude is still present at the valve drive 24.

Figure 6:
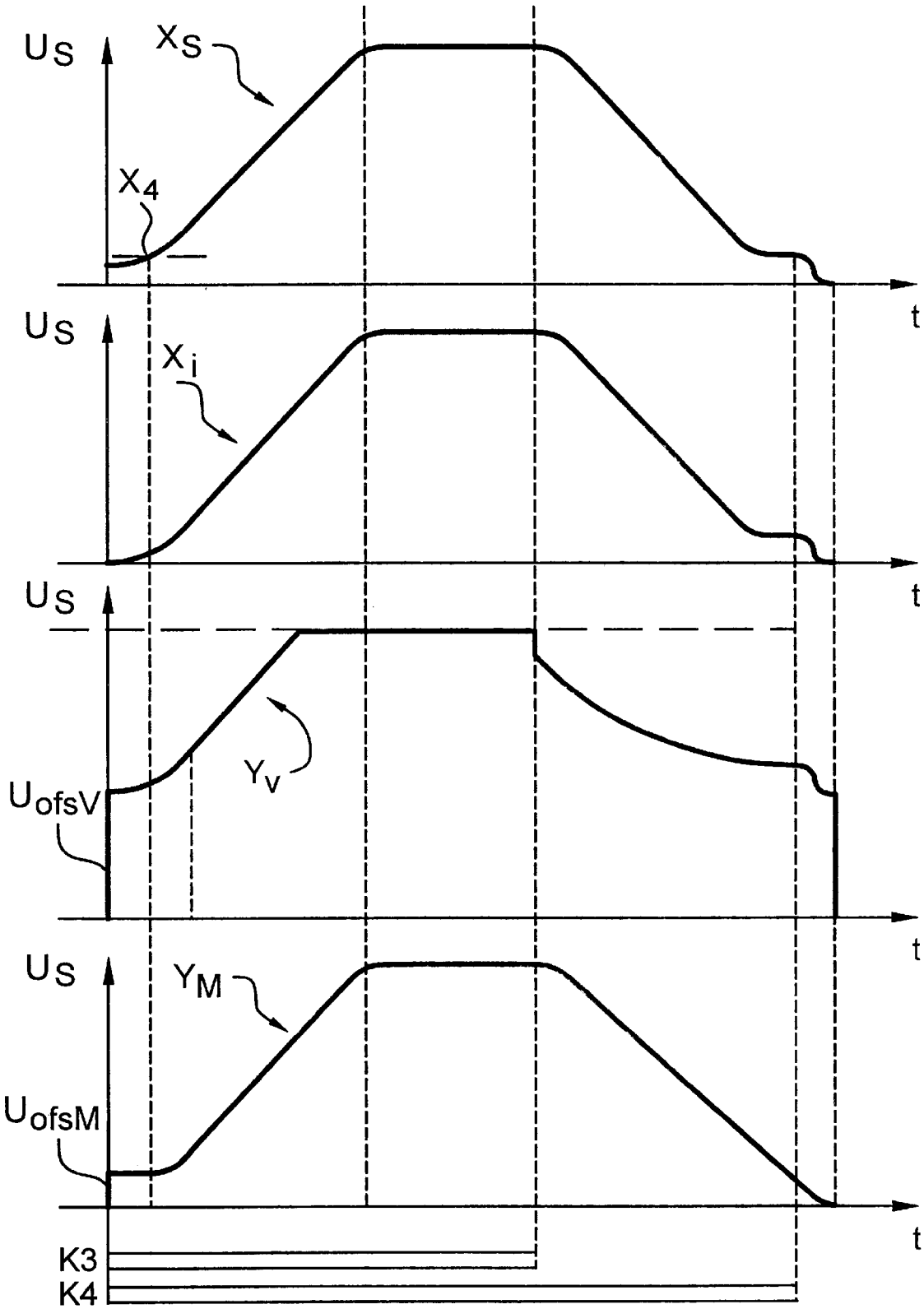

In FIG. 6, a second variant for downward travel is shown. This variant differs from the variant shown in FIG. 5 in the same way as is the case for the upward travel of FIG. 4 in comparison with the upward travel of FIG. 3: In this variant, the ramp functions are omitted, and governing is employed from the outset.

In both variants of the downward travel, the opening the down valve 48 causes the pressure, exerted by the car 2, in the cylinder line 44 and the pump line 42 to act on the oil pump 40 in such a way that the oil pump 40 is driven by pressurized oil. The motor 39 coupled with the oil pump 40 accordingly requires no energy but instead now acts as a generator. With the aid of the control signal $Y_M$, the rpm of the motor 39 is governed. The electrical energy generated by the motor 39 is selectively converted into heat in the brake unit 81 or converted into re-usable electrical energy by means of the return feed unit 82 and fed back into the power supply network L1, L2, L3. It is accordingly a requirement that one of these two units 81, 82 be present.

The third signal converter 30 mentioned at the outset receives information from the control block 19 on the operating state. The signal converter 30 outputs the information on the travel direction, that is, upward or downward travel, to the power supply part 28, and thus the power supply part 28 together with the power setter 29 can switch over between drive control and braking control.

For the sake of completeness it will also be noted that the aforementioned status signals SST serve to inform the desired value generator 12, and consequently the control block 19 also, about the actual operating state of the power supply part 28. It is thus possible for instance to detect a malfunction in the power supply part 28 and to have the control block 19 take the necessary measures to achieve safety.

The control and governing unit 10 is advantageously embodied as a microprocessor controller. The details shown in FIG. 1, with the desired value generator 12 and the control block 19 and their mode of operation, are then realized in the form of program code. The inputs and outputs of the control and governing unit 10 are then formed by analog/digital and digital/analog converters, respectively.

In the event that in a hydraulic elevator an oil pump 40 with a very low leakage rate is employed, it may be advantageous to utilize the triggering according to the invention of a valve unit 43 correspondingly for upward travel at low speed as well.

We claim:

1. A method for controlling a hydraulic elevator, having a car (2), which is movable up and down along an elevator shaft (1), a reciprocating piston connected to the car (2), a reciprocating cylinder (3) for driving the reciprocating piston, an oil pump (40) for driving the car (2) by means of pressurized oil, a motor (39), supplied by a controllable power supply part (28), for driving the oil pump (40), a valve unit (43) which is built in between a pump line (42) and a cylinder line (44), a sensor (13) for sensing the speed of the car (2), and a control and governing unit (10), with which the movement of the car (2) can be varied, wherein the car (2) is operated at at least two rated speeds, namely at a first speed (fast speed) and a second speed (creep speed), and transitional phases between these two speeds on the one hand, and the second speed (creep speed) and a stop on the other, the transitional phases being distinguished by a continuous change in speed, characterized in that upon downward motion at a speed approximately equal to or less than the second speed (creep speed), the regulation of the speed of the car (2) by the control and governing unit (10) is effected on the basis of the signal of the sensor (13) in such a way that regulating action is exerted on the valve unit (43), while in downward motion with a speed approximately equal to or greater than the second speed (creep speed) and in upward motion, the regulation of the speed of the car (2) is effected in such a way that regulating action is exerted on the power supply part (28) and thus on the motor (39) and the oil pump (40).

2. The method of claim 1, characterized in that in downward motion at a speed approximately equal to or less than the second speed (creep speed), the rpm of the oil pump (40) is determined by predetermined values.

3. The method of claim 1, characterized in that the speed of the car (2) is the sole controlled variable, and that as the sensor, a flow rate meter (13) is used whose actual value $x_i$ is delivered to the control and governing unit (10).

4. The method of one of claim 1, characterized in that when the motion of the car (2) is started, before the onset of regulation of the speed of the car (2), there is a phase with open-loop control of the speed of the car (2) at predetermined values for the speed, which phase is terminated when the speed attains a predetermined value ($U_1$, $x_1$,).

5. An apparatus for controlling a hydraulic elevator, having a car (2), which is movable up and down along an elevator shaft (1), a reciprocating piston connected to the car (2), a reciprocating cylinder (3) for driving the reciprocating piston, an oil pump (40) for driving the car (2) by means of pressurized oil, a motor (39), supplied by a controllable power supply part (28), for driving the oil pump (40), a valve unit (43) which is built in between a pump line (42) and a cylinder line (44), a sensor (13) for sensing the speed of the car (2), and a control and governing unit (10), with which the movement of the car (2) can be varied, wherein the car (2) is operated at at least two rated speeds, namely at a first speed (fast speed) and a second speed (creep speed), and transitional phases between these two speeds on the one hand, and the second speed (creep speed) and a stop on the other, the transitional phases being distinguished by a continuous change in speed, characterized in that the control and governing unit (10) has means (12, 18, 19, 22, 27), with the aid of which the oil pump (40) and the valve unit (43) are triggerable in such a way that upon downward motion at a speed approximately equal to or less than the second speed (creep speed), the regulation of the speed of the car (2) by the control and governing unit (10) is effected on the basis of the signal of the sensor (13) in such a way that regulating action is exerted on the valve unit (43), while in downward motion with a speed approximately equal to or greater than the second speed (creep speed) and in upward motion, the regulation of the speed of the car (2) is effected in that regulating action is exerted on the power supply part (28) and thus on the motor (39) and the oil pump (40).

6. The apparatus of claim 5, characterized in that the control and governing unit (10) has a desired value generator (12), which generates as a function of control command signals K present at an input, desired values for the speed of the car (2), desired values $x_M$ for the motor rpm and desired values $x_V$ for triggering the valve unit (43), that a governor (18) is present, which from the applicable desired value $x_s$ for the speed of the car (2) and an actual value $x_i$, detected by the sensor (13), for the speed of the car (2) finds a controlling variable y, that a control block (19) is present, which as a function of the drive command signals (K), the controlling variable y and the desired values ($x_M$ ) and ($x_V$) generates a control command $Y_V$ for the valve unit (43) and a control command ($Y_M$ ) for the motor (39), and that in downward motion at a speed approximately equal to or less than the second speed (creep speed), the control command ($Y_V$ ) for the valve unit (43) represents the controlled variable of the closed control loop, while in downward motion at a speed approximately greater than the second speed (creep speed) and in upward motion, the control command ($Y_M$ ) for the motor (39) represents the controlled variable of the closed control loop.

7. The apparatus of claim 6, characterized in that the sensor for the speed of the car (2) is a flow rate meter (13), whose actual value $x_i$ is determinative, in all speed ranges, for the regulation of the speed of the car (2).

8. The apparatus of one of claim 1, characterized in that the valve unit comprises a check valve (47) and a down valve (48), disposed parallel to the check valve, and the check valve (47) opens whenever the pressure in the pump line (42) is greater than the pressure in the cylinder line (44), and that the down valve (48) is triggerable by the control and governing unit (10).

9. The apparatus of claim 8, characterized in that the down valve (48) comprises a pilot control valve (50) and a control valve (49) actuated by this pilot control valve (50).

10. The apparatus of claim 9, characterized in that the pilot control valve (50) is electrically triggerable.

11. The apparatus of claim 10, characterized in that the electrically triggerable drive of the pilot control valve (50) has a valve drive (24), which effects a change in an opening cross section of the pilot control valve (50).

* * * * *